US012757972B2

(12) United States Patent
Mujtaba

(10) Patent No.: US 12,757,972 B2
(45) Date of Patent: Oct. 13, 2026

(54) FOOTWEAR POWERED BY SELF-GENERATING ELECTRICITY

(71) Applicant: Yusef Mujtaba, Fort Myers, FL (US)

(72) Inventor: Yusef Mujtaba, Fort Myers, FL (US)

( * ) Notice: Subject to any disclaimer, the term of this patent is extended or adjusted under 35 U.S.C. 154(b) by 476 days.

(21) Appl. No.: 17/991,477

(22) Filed: Nov. 21, 2022

(65) Prior Publication Data

US 2024/0164472 A1 May 23, 2024

(51) Int. Cl.
*A43B 3/46* (2022.01)
*A43B 3/40* (2022.01)
*A43B 3/48* (2022.01)

(52) U.S. Cl.
CPC ..... *A43B 3/46* (2022.01); *A43B 3/40* (2022.01); *A43B 3/48* (2022.01)

(58) Field of Classification Search
CPC .... A43B 3/40; A43B 3/46; A43B 3/48; A43B 3/38; A43B 3/34; A43B 3/42
See application file for complete search history.

(56) References Cited

U.S. PATENT DOCUMENTS 4,783,909 A * 11/1988 Van Doren ..... A43B 3/242 36/68
2011/0153197 A1* 6/2011 Song ..... A43B 3/48 702/139
2012/0018418 A1* 1/2012 Shantha ..... A43B 3/35 219/482
2013/0087180 A1* 4/2013 Stark ..... H10N 10/13 136/205
2013/0104425 A1* 5/2013 Kalra-Lall ..... A43B 3/42 36/83
2014/0266570 A1* 9/2014 Sharma ..... A43B 3/48 340/4.12
2019/0082771 A1* 3/2019 Shin ..... A43B 3/34
2022/0193490 A1* 6/2022 Ghiotto ..... A43B 3/44

FOREIGN PATENT DOCUMENTS

CN 105662795 A * 6/2016
CN 106307772 A * 1/2017 ..... A43B 13/22
CN 108270280 A * 7/2018
KR 101856999 B1 * 5/2018 ..... A43B 3/34
WO WO-2010085163 A1 * 7/2010 ..... A43B 13/12

OTHER PUBLICATIONS

CN-105662795-A English machine translation (Year: 2016).*
CN-108270280-A English machine translation (Year: 2018).*
CN-106307772-A English machine translation (Year: 2017).*
KR-101856999-B1 English machine translation (Year: 2018).*

* cited by examiner

*Primary Examiner* — Andrew J Golden
(74) *Attorney, Agent, or Firm* — CANTOR COLBURN LLP

(57) ABSTRACT

A footwear and a method of walking are disclosed. The footwear includes a thermoelectric generator for generating electrical power and an electrical device. The thermoelectric generator generates electrical power via a thermoelectric generator while the footwear is being worn based on a temperature difference across the thermoelectric generator when the footwear is being worn. The electrical power is used to operate the electrical device.

8 Claims, 3 Drawing Sheets

FOOTWEAR POWERED BY SELF-GENERATING ELECTRICITY

INTRODUCTION

The subject disclosure relates to wearable technology and, in particular, to footwear capable of powering and operating electronic devices when a person is travelling by foot.

Pedestrians depend on smartphones or other electrical devices to guide then along a trajectory. This means that they constantly are turning their attention to smartphone displays to get updates on their progress. Doing so leaves them unaware of their surroundings and vulnerable to surrounding traffic, etc. Accordingly, it is desirable to provide a method for guiding a pedestrian along a trajectory without requiring the pedestrian's full attention.

SUMMARY

In an exemplary embodiment, a footwear is disclosed. The footwear includes a thermoelectric generator for generating electrical power and an electrical device that operates using the electrical power.

In addition to one or more of the features described herein, the thermoelectric generator is oriented in the footwear with a first side facing an interior of the footwear and a second side facing an outside environment of the footwear, wherein the thermoelectric generator generates an electrical current in response to a temperature difference between the first side and the second side. The footwear further includes a power bank for storing the electrical power generated by the thermoelectric generator. The footwear further includes a port configured to receive a cable that charges the power bank. The footwear further includes a cover for the port. The electrical device includes at least one of a vibrator, a Global Positioning Satellite device (GPS device), and a wireless communication unit. The footwear further includes a processor configured to receive a GPS coordinate from the GPS device and track an actual trajectory of a person wearing the footwear based on the GPS coordinate. The processor sends an activation signal to the vibrator based on a difference between the actual trajectory of the person and a pre-selected trajectory. The processor is configured to communicate wirelessly with at least one of an electronic communication device, a smartphone, and another footwear. The footwear is at least one of a shoe, a sneaker, an insert to a shoe, an article that is strapped to a foot, and an article that is strapped to an ankle.

In another exemplary embodiment, a method of walking is disclosed. The method includes generating electrical power via a thermoelectric generator in a footwear being worn and operating an electrical device using the electrical power.

In addition to one or more of the features described herein, the thermoelectric generator is oriented in the footwear with a first side facing an interior of the footwear and a second side facing an outside environment of the footwear, and the method further includes generating an electrical current in response to a temperature difference between the first side and the second side. The method further includes storing the electrical power generated by the thermoelectric generator at a power bank disposed in the footwear. The method further includes plugging a cable into a port located in the footwear and charging the power bank via the cable. The method further includes protecting the port via cover. The electrical device includes at least one of a vibrator, a Global Positioning Satellite device (GPS device), and a wireless communication unit. The method further includes receiving a GPS coordinate at a processor located in the footwear from the GPS device and tracking an actual trajectory of a person wearing the footwear based on the GPS coordinate via the processor. The method further includes sending an activation signal from the processor to the vibrator based on a difference between the actual trajectory of the person and a pre-selected trajectory. The method further includes communicating wirelessly between the processor and at least one of an electronic communication device, a smartphone, and another footwear. The footwear is at least one of a shoe, a sneaker, an insert to a shoe, an article that is strapped to a foot, and an article that is strapped to an ankle.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
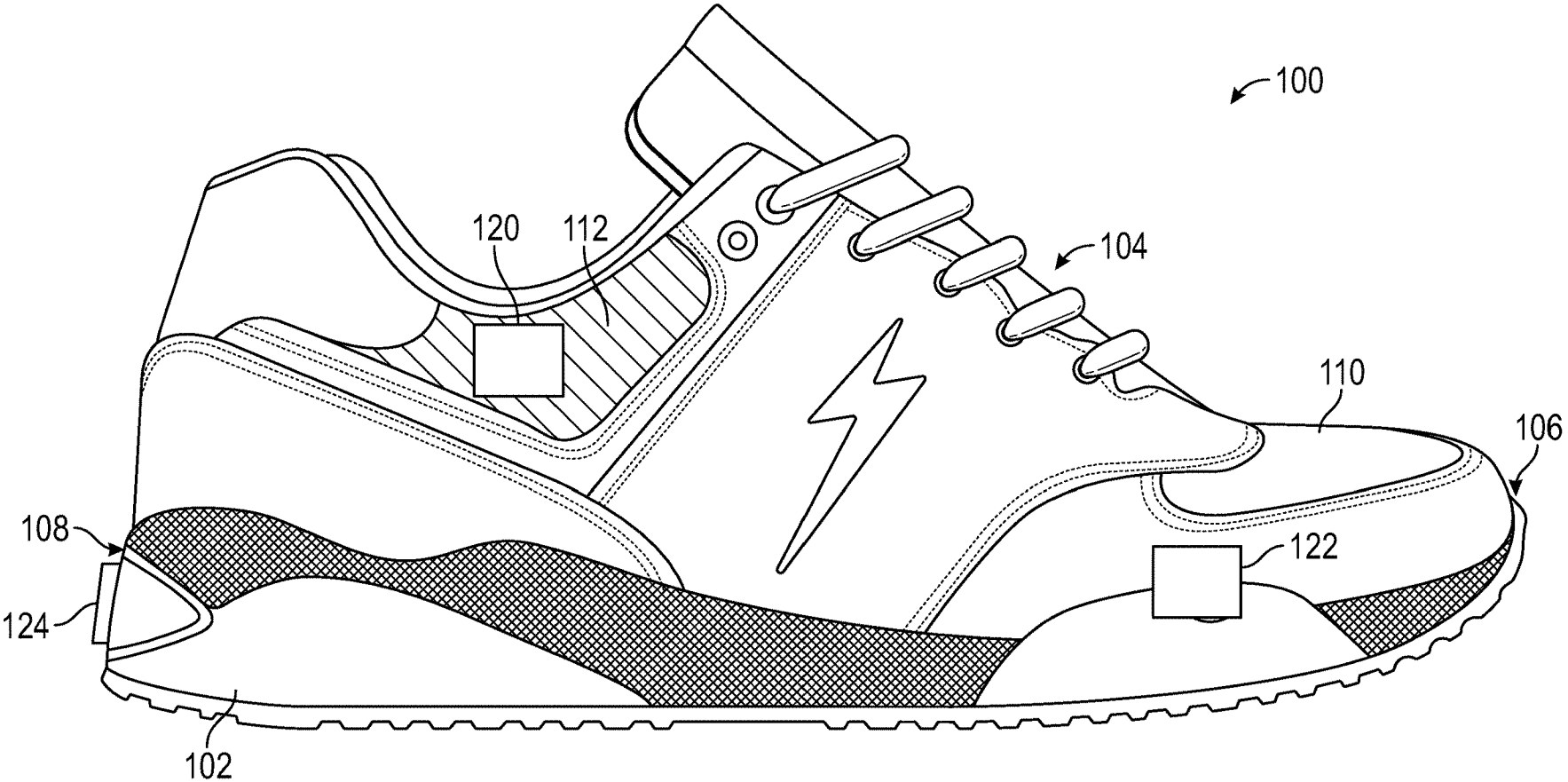
FIG. 1 shows a shoe in an illustrative embodiment.

The following description is merely exemplary in nature and is not intended to limit the present disclosure, its application or uses. It should be understood that throughout the drawings, corresponding reference numerals indicate like or corresponding parts and features.

FIG. 1 shows footwear 100 in an illustrative embodiment. As discussed herein, the footwear 100 is a sneaker. However, in alternative embodiments, the footwear 100 can be any footwear or article for wearing on a foot, such as a shoe, a dress shoe, a loafer, a boot, a sandal, etc. The footwear 100 can also be an insert to one of the shoe, dress shoe, loafer, boot, sandal, etc., or an article that can be strapped on to the foot or to an ankle. The footwear 100 includes a sole 102 and an upper 104. The sole 102 extends from a toe 106 to a heel 108. The upper 104 can include a toe cap 110, an inside quarter 112 and an outside quarter (not shown).

The footwear 100 includes a thermoelectric generator (TEG 120). The TEG 120 is a device that includes a first side and a second side, such that a temperature difference between the first side and the second side generates an electrical current. In general, the second side is opposite the first side. In various embodiments, the TEG 120 is located at either the inside quarter 112 or the outside quarter. The TEG 120 can be embedded within a layer of the footwear 100 or contained within a cavity formed within the upper 104. The TEG 120 is oriented so that the first side faces an interior of the footwear 100 and a second side faces an outside environment of the footwear. Thus, when a person places his or her foot within the footwear 100, a temperature difference occurs naturally between the first side and the second side, with first side experiencing a higher temperature (that of the person's foot) and the second side experiencing a lower temperature (that of the environment). In one embodiment, the TEG 120 can be made of a flexible material. Thus, the TEG 120 can change its shape along with the material in which it is embedded (e.g., the inside quarter 112), thereby allowing the TEG 120 to feel comfortable against the person's foot.

The footwear 100 further includes a vibrator 122 that can be activated to vibrate upon receiving an activation signal. The footwear 100 also includes a port into which a cable can be plugged. A cover 124 to the port is shown in FIG. 1.

Figure 2:
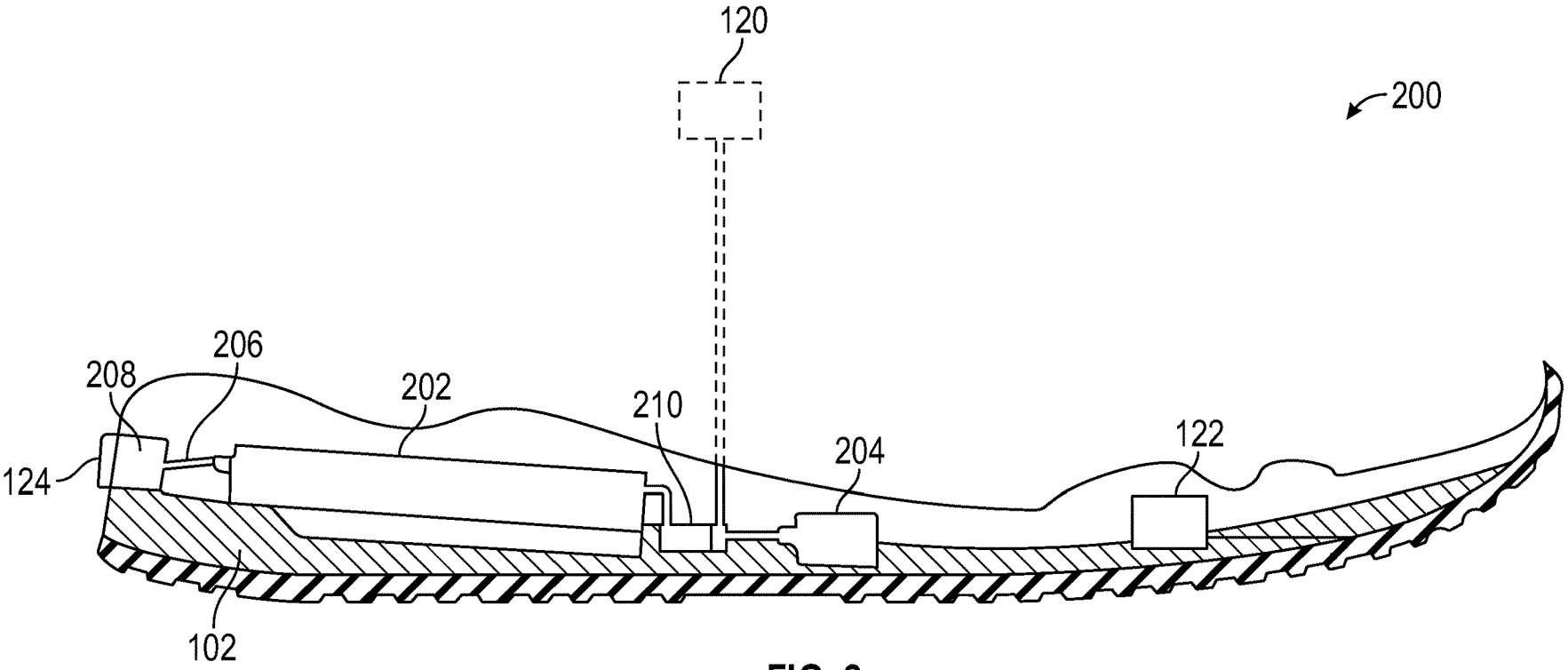
FIG. 2 shows a cross-sectional side view of the sole of the shoe, in an embodiment.

FIG. 2 shows a cross-sectional side view 200 of the sole 102 of the footwear 100, in an embodiment. The sole 102 includes a battery 202 or power bank, a Global Positioning Satellite device (GPS device 204) or GPS receiver, and a controller 210. The battery 202 stores energy generated by the TEG 120. While the energy produced by the TEG 120 can be small with respect to the power demands of the footwear 100, the electrical energy can be accumulated at the battery 202. The battery 202 can then be used to provide electrical power to the electrical devices of the footwear 100, such as the vibrator 122, GPS device 204, controller 210, etc.

The GPS device 204 provides GPS coordinates that help to track the location and orientation of the footwear 100 and thus the general heading of the person wearing the footwear.

The controller 210 includes a motherboard, processor, memory and a wireless communication unit. The controller 210 can be in data communication with the GPS device 204 and the vibrator 122, as well as with devices external to or remote from the footwear 100 via the wireless communication unit. For example, the controller 210 in one footwear of a pair of footwear (e.g., pair of shoes) can communicate with a controller in another footwear of the pair.

In various embodiments, the memory at the controller 210 can be used to store a pre-selected trajectory for the person wearing the footwear 100. The controller 210 can receive the GPS coordinates from the GPS device 204 and track the progress of the person using the GPS coordinates. The controller 210 can also perform calculations using the actual trajectory of the person and the pre-selected trajectory in order to determine an instruction for the person that maintains the person along the pre-selected trajectory. The controller 210 can then send instructions to the person in the form of a vibration at the vibrator 122. For example, when the controller 210 determines that the person should turn left, the vibrator 122 in the left footwear can be activated. Similarly, when the person should turn right, the vibrator 122 in the right footwear can be activated.

Electrical wires 206 connect the battery 202 to port 208. In various embodiments, the port 208 is a USB port into which a USB cable can be plugged. The battery 202 can be charged via electricity flowing through the USB cable. Charging can thus occur whether a person is wearing the footwear or not. Data can also be transmitted into or out of the footwear 100 via the USB cable.

Cover 124 is located at the port 208. The cover 124 can be placed in either an open position to allow the cable to be plugged into the footwear 100 or a closed position when the cable is removed to protect the port and prevent dirt and debris from entering the port.

Figure 3:
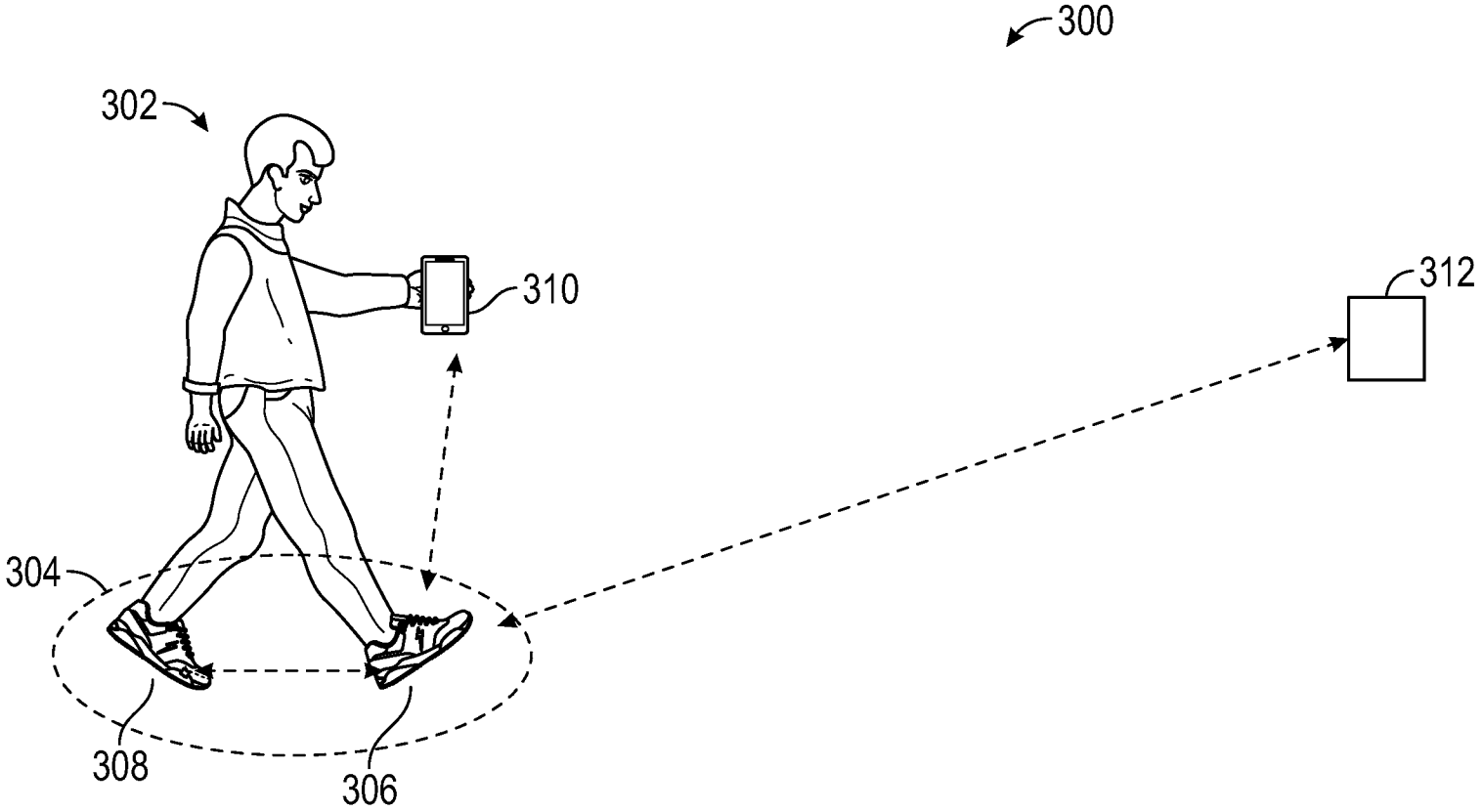
FIG. 3 is a diagram illustrating wireless communication between the shoe and other devices.

FIG. 3 is a diagram 300 illustrating wireless communication between the footwear 100 and other devices. Person 302 is wearing a pair of shoes 304 including a left shoe 306 and right shoe 308. The person 302 is in possession of a smartphone 310 or other suitable electronic communication device. The person 302 can interact with the smartphone 310 to select or design a trajectory for the person to travel. The smartphone 310 can then transmit the selected trajectory wirelessly to the either or both of the left shoe 306 and right shoe 308 (i.e., to the controller(s) therein).

The smartphone 310 can also be used to manage or set up software within the pair of shoes 304 for operation. Once the selected trajectory has been transmitted to the pair of shoes 304, the shoes have all of the data needed to guide the person through the selected trajectory. In addition, the GPS coordinates can be transmitted directly from a GPS satellite 312 or other GPS system to the pair of shoes 304. The smartphone 310 thus is no longer needed and can be put away, turned off or left behind. This allows the person 302 to be able to move around with his or her head up and thus with full awareness of his or her surroundings.

Data can also be communicated between the left shoe 306 and the right shoe 308. For example, if the controller 210 is in the right shoe 308, it can communicate data to the controller and/or the vibrator in the left shoe 306.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A footwear, comprising:

a thermoelectric generator for generating electrical power, wherein the thermoelectric generator is disposed at one of an inside quarter and an outside quarter of the footwear and oriented with a first side facing an interior of the footwear and a second side facing an outside environment of the footwear, wherein the thermoelectric generator generates an electrical current in response to a temperature difference between a first temperature of a person's foot at the first side and a second temperature of the outside environment at the second side;

a GPS device that operates using the electrical power;

a vibrator that operates using the electrical power; and a processor that operates using the electrical power, the processor configured to receive a GPS coordinate from the GPS device and track an actual trajectory of a person wearing the footwear based on the GPS coordinate and further configured to send an activation signal to the vibrator based on a difference between the actual trajectory of the person and a pre-selected trajectory.

2. The footwear of claim 1, further comprising a power bank for storing the electrical power generated by the thermoelectric generator.

3. The footwear of claim 2, further comprising a port configured to receive a cable that charges the power bank.

4. The footwear of claim 3, further comprising a cover for the port.

5. The footwear of claim 1, further comprising a wireless communication unit.

6. The footwear of claim 5, wherein the processor is configured to communicate wirelessly with at least one of: (i) an electronic communication device; and (ii) a smartphone.

7. The footwear of claim 5, further comprising a right shoe and a left shoe, wherein the processor is in one of the right shoe and the left shoe and the vibrator is in the other of the right shoe and the left shoe.

8. The footwear of claim 1, wherein the footwear is at least one of: (i) a shoe; (ii) a sneaker; (iii) an insert to a shoe; (iv) an article that is strapped to a foot; and (v) an article that is strapped to an ankle.

* * * * *